US005402544A

United States Patent [19]

Crawford et al.

[11] Patent Number: 5,402,544

[45] Date of Patent: Apr. 4, 1995

[54] COMBINATION CHAIR AND GURNEY

[75] Inventors: Michael K. Crawford; Joseph M. Crawford; James R. Crawford, all of Houston, Tex.

[73] Assignee: Easy Lift Care Products, Inc., Houston, Tex.

[21] Appl. No.: 123,601

[22] Filed: Sep. 17, 1993

[51] Int. Cl.[6] ..... A61G 7/015; A61G 7/018; A61G 7/16; A47C 17/04

[52] U.S. Cl. ..... 5/616; 5/618; 297/344.17; 297/354.13; 74/89.15; 74/441; 74/521

[58] Field of Search ..... 5/618, 616, 617, 613, 5/81.1, 86.1; 297/344.17, 354.13; 74/89.15, 441, 521

[56] References Cited

U.S. PATENT DOCUMENTS

| | | | |
|---|---|---|---|
| 1,748,784 | 2/1930 | Mierley . | |
| 2,587,068 | 2/1952 | Sanders | 5/81.1 |
| 2,631,300 | 3/1953 | Murray | 5/618 |
| 2,682,913 | 7/1954 | Scheide | 5/618 |
| 2,694,437 | 11/1954 | Glaser | 297/83 |
| 2,869,614 | 1/1959 | Wamsley . | |
| 2,913,738 | 11/1959 | Wise . | |
| 3,147,039 | 9/1964 | Smith et al. | 297/90 |
| 3,284,093 | 11/1966 | Engelmeier . | |
| 3,406,772 | 10/1968 | Ahrent et al. . | |
| 3,848,702 | 8/1975 | Goodman | 5/618 |
| 3,967,328 | 7/1976 | Cox | 5/81.1 |
| 4,190,913 | 3/1980 | DiMatteo et al. | 5/81.1 |
| 4,255,823 | 3/1981 | Boyer et al. | 5/81.1 |
| 4,285,541 | 8/1981 | Onishi | 5/81.1 |
| 4,432,359 | 2/1984 | James | 5/81.1 |
| 4,453,732 | 6/1984 | Assanah et al. | 5/81.1 |
| 4,559,655 | 12/1985 | Peck | 5/617 |
| 4,717,169 | 1/1988 | Shaffer | 280/250.1 |
| 4,726,082 | 2/1988 | DiMatteo et al. | 5/81.1 |
| 4,754,508 | 7/1988 | Nishiguchi | 5/617 |
| 4,787,104 | 11/1988 | Grantham | 5/81.1 |
| 4,839,933 | 6/1989 | Plewright et al. | 5/81.1 |
| 4,856,123 | 8/1989 | Henderson et al. | 5/81.1 |
| 4,858,260 | 8/1989 | Failor et al. | 5/618 |
| 4,966,379 | 10/1990 | Mulholland | 280/250.1 |
| 4,997,200 | 3/1991 | Earls | 5/81.1 |
| 5,048,133 | 9/1991 | Iura et al. | 5/81.1 |

*Primary Examiner*—Alexander Grosz
*Attorney, Agent, or Firm*—Bush, Moseley, Riddle & Jackson

[57] ABSTRACT

A combined mobile chair and gurney (10) having an outer base support frame (12) and an inner movable frame (14). Outer support frame (12) has a pair of opposed vertical side frames (16) and a plurality of lower cross members (30) extending between the lower ends of the side frames (16). Inner movable frame (12) has a lower base (84) supported on cross members (30) of the outer frame (12), and a pair of linkages (72, 74) supported on the base (84) connected to three hinged segments (48, 52, 54) which define a rear back support segment (48), an intermediate seat support segment (52), and a front leg support segment (54). The linkages (72, 74) are operatively connected to drive nuts (106, 126) which are mounted on an externally threaded power screw (108) for movement. A patient is supported in a supine position at the uppermost position of the hinged segments (48, 52, 54) shown in FIG. 2 and is supported in a seated position at a lower position of the hinged segments (48, 52, 54) as shown in FIGS. 4 and 5. A modification is shown in FIGS. 10–13 in which manual actuation of the chair and gurney (10A) by a handle (152A) may be provided from either side of the chair and gurney (10A) as may be predetermined.

11 Claims, 7 Drawing Sheets

FIG. 8
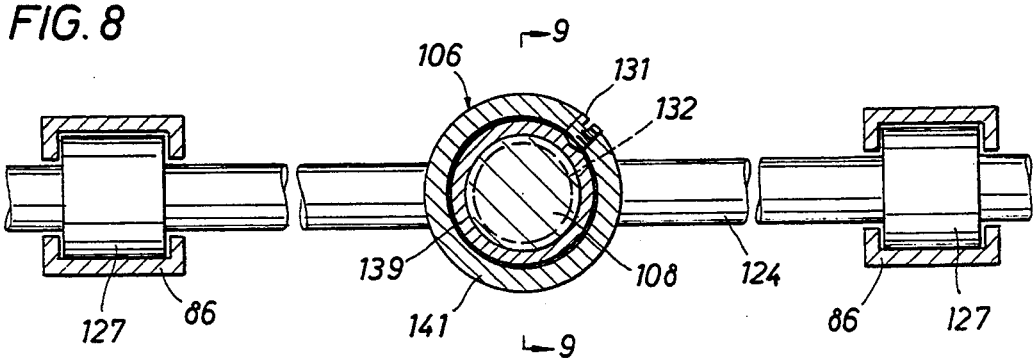
FIG. 9
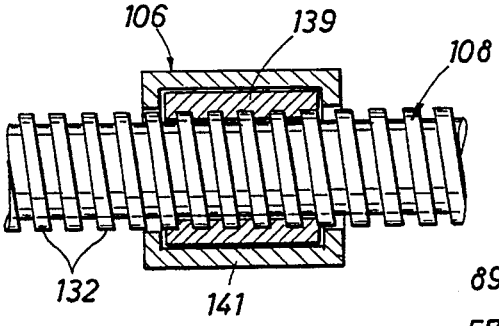
FIG. 12
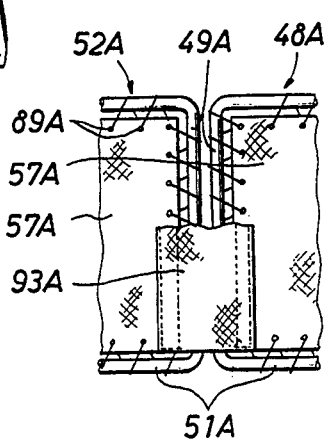
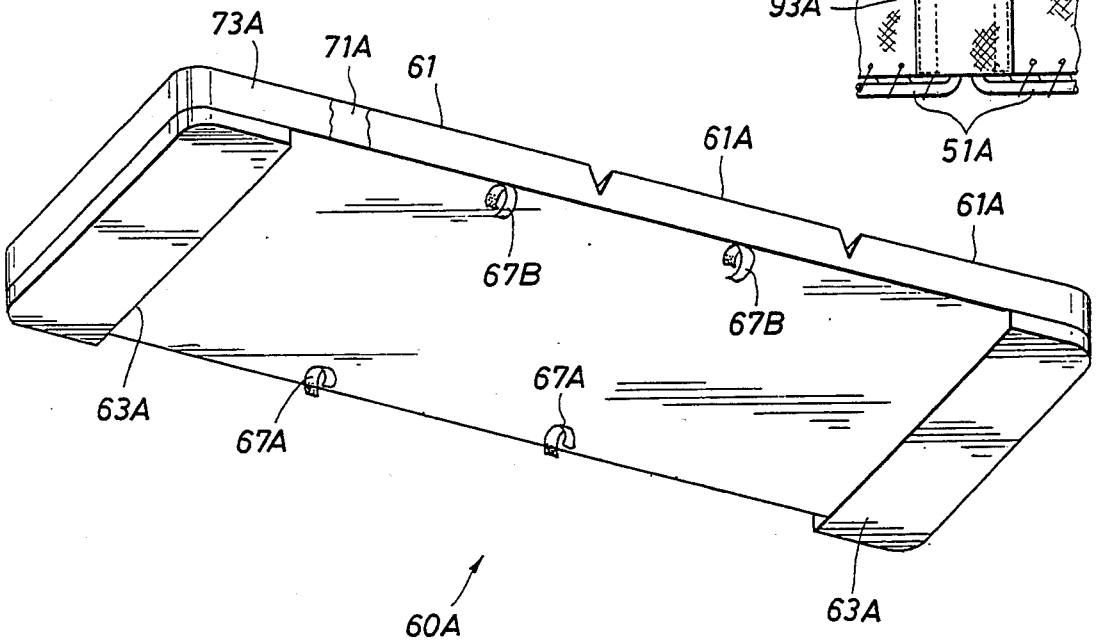
FIG. 13

COMBINATION CHAIR AND GURNEY

FIELD OF THE INVENTION

This invention relates to a combination chair and gurney for patients in hospitals, nursing homes, or similar health care facilities, and more particularly to such a combined chair and gurney in which the chair is easily converted into a gurney.

BACKGROUND OF THE INVENTION

There are currently more than twenty-five million citizens in the United States who are temporarily or permanently totally disabled. These people reside in nursing homes, hospitals, rehabilitation facilities or in homes where they are totally dependent upon the care of others for their survival. Most of these millions of disabled persons are bladder and/or bowel incontinent and are forced to wear diapers or comparable items to contain their urine and excreta. Many of these people suffer from Alzheimers disease or other dementia and are unable to assist or only partially assist in their own care or handling.

Many are confined to bed unless removed from their beds by attending persons. The typical method of removing a disabled person from a bed is to raise the disabled person to a sitting position, rotate the patient to a sitting position on the side of the bed and with an attendant under each arm and an attendant standing and facing the patient, stand or pick the patient up and then turn and lower the patient into a chair, wheelchair, geriatric chair, or on to some other conveying mechanism.

In a typical nursing home, hospital, rehabilitation facility or in the home environment, the disabled incontinent person must have diaper changes at least every two hours and possibly several times an hour for hygiene, as well as prevention of skin irritation and prevention of bed sores. To accomplish a diaper change for any purpose, it is necessary for the attendants to take the disabled person to a bed, lift the disabled person from the wheelchair, geriatric chair, or other seating arrangement, place the person on the bed, change the diaper, and reverse the procedure to return the disabled person to the original seating arrangement. The result of physically handling disabled persons is that many older people sustain spontaneous bone fractures, muscle and ligament pulls or tears, or pain solely from the physical handling and lifting. Another direct consequence of the existing practice outlined above is that the attendants suffer high incidents of injuries to their backs, muscles or ligaments as a result of physically lifting disabled persons from sitting positions onto beds and returning them to their sitting positions. This consequence usually requires that institutions pay the highest workman's compensation insurance rates, and are required to hire additional attendants to perform the lifting and handling of disabled persons. In the home environment the consequence is that the disabled person is essentially confined to bed.

Thus, the problem is that millions of disabled persons in institutions or at home are being moved from beds to chairs or other appliances by the physical strength of their attendants with resulting injuries both to the patient and attendants; or the patient is never or seldom moved from the bed, with resulting bed sores, bad hygiene and circulatory problems. Such problems have greatly increased the cost of care of disabled persons through high insurance costs, additional labor, injuries and litigation.

Heretofore, a combined chair and gurney has been provided. For example, U.S. Pat. No. 2,587,068 dated Feb. 26, 1952 shows a combined chair and gurney which is convertible from a chair to a gurney at the same height as a bed or operating table for transfer if desired. A frame supporting the patient is mounted for pivotal movement between various positions on a lower support frame mounted between wheels or casters. The seat supporting the patient remains in a horizontal position at all times and can not be inclined. Also, side frames are not provided-alongside the seat at all times for support of the patient.

U.S. Pat. No. 3,147,039 dated Sep. 1, 1964 likewise shows a combined wheelchair and gurney which is convertible for transport of a patient either in a sitting or lying position. A pair of side frames are provided to support a linkage for converting the transportation of a patient between a sitting position and a lying position. The back seat frame and the leg seat frame are both connected to and supported by the opposed side frames, and the seat frame remains positioned horizontally at all times.

SUMMARY OF THE INVENTION

The present invention is directed to a convertible chair on wheels or casters which is easily changed by an attendant into a gurney which is the same height as a patient bed. The chair is designed to allow a disabled patient to be slipped or turned from the surface of the bed onto the chair in its gurney position, then gently lowered into an infinitely adjustable sitting and/or reclining position. When the disabled person needs a diaper change or other services, the attendant simply and easily raises the disabled person to the horizontal gurney position, changes the patient's diaper or performs other needed medical, physical or hygienic requirements, and then simply and easily lowers a patient to a desired sitting/reclining position.

Patients benefit from use of the convertible chair because they are never physically lifted by attendants with the possible resulting injuries, and the patients can be kept much cleaner because of the ease and frequency with which they can be administered. In addition, patients benefit because they frequently move, thereby eliminating pressure points which cause bed sores. A post-operative patient also benefits from the changing sitting/reclining/horizontal positions in that his circulatory system is exercised by his frequent, yet gentle movement. When frequent or periodic physical movement of a patient is required, the chair can be fitted with a power driver with automatic controls, which move the patient to the degree and in the frequency desired.

The present invention provides a mobile transport device for a patient convertible between a chair with the patient in a seated position and a gurney with the patient in a supine position. The movable support frame for the patient includes a center seat support segment or panel which is in an inclined position during the seated position of the patient but moves to a horizontal position in the uppermost raised position which defines a gurney. The inclination of the center seat support segment changes continuously from the lowermost position to the uppermost position and may be preselected according to the desire of the patient.

The movable support frame includes a back support segment or panel that is connected only to the center seat support panel and is supported by rollers for sliding movement relative to the side frames. Such a sliding movement of the back support panel facilitates the pivotal movement of the movable support frame between lowermost and uppermost positions thereof. The back support panel is tilted up or down by the movement of the seat support panel. When the seat segment lowers, the back segment slowly tilts up as its front edge follows the seat support segment.

The inner movable support frame, which includes the three hinged support panels or segments, easily fits within an outer main support frame which includes a pair of side frames supported on rollers. The actuating means for movement of the inner frame is mounted between the outer main support frame and the inner movable frame. Separate linkages are mounted beneath the seat support panel and the leg support panel. Each linkage is operatively connected to a drive nut in threaded engagement with an externally threaded power screw. Manually operable means are connected to the power screw for selective rotation of the screw and movement of the linkages and associated panels between a lowermost position with the patient in a seated inclined position and an uppermost position with the patient in a supine position at the upper ends of the side panels. Each of the linkages is connected to a drive nut in threaded engagement with the external screw threads of an externally threaded screw. The screw has a right hand thereof on one portion thereof engaging one nut and a left hand screw thread on another portion thereof engaging the outer nut. Thus, upon rotation of the screw, the nuts move in opposite directions along the screw for simultaneously raising or lowering the linkages and associated support panels. The screw may be rotated by suitable manual means such as a hand operated crank or by power means with automatic controls, if desired.

It is an object of this invention to provide a combined mobile chair and gurney in which an inner movable frame, including three hinged support segments, is mounted for relatively free hinged movement between a pair of side frames forming an outer support frame.

It is a further object of this invention to provide such a combined mobile chair and gurney having actuating means for moving the inner movable frame at selective positions between a lowermost position of the hinged support segments at different angular relations to each other and an uppermost position of the hinged support segments in which all of the segments are aligned horizontally at the upper end of the side frames to define a gurney for moving a patient to a supine position.

Another object of this invention is to provide a combined mobile chair and gurney having actuating means which may be mounted on a selected side of the combined chair and gurney for manual actuation.

Other objects, features, and advantages of the invention will be apparent from the following specification and drawings.

BRIEF DESCRIPTION OF THE DRAWINGS

FIG. 8 is an enlarged front elevation of the drive nut and drive screw for the linkage connected to the leg support segment;

FIG. 9 is a section view taken along line 9—9 of FIG. 8 and showing a thrust bearing for the drive nut;

FIG. 12 is a fragment of a pair of hinged segments showing a backing on the segments for supporting a patient; and FIG. 13 is a perspective view of a modified pad for removable attachment to the frame of the combined chair and gurney and adapted to support a patient thereon.

DESCRIPTION OF THE INVENTION

Figure 1:
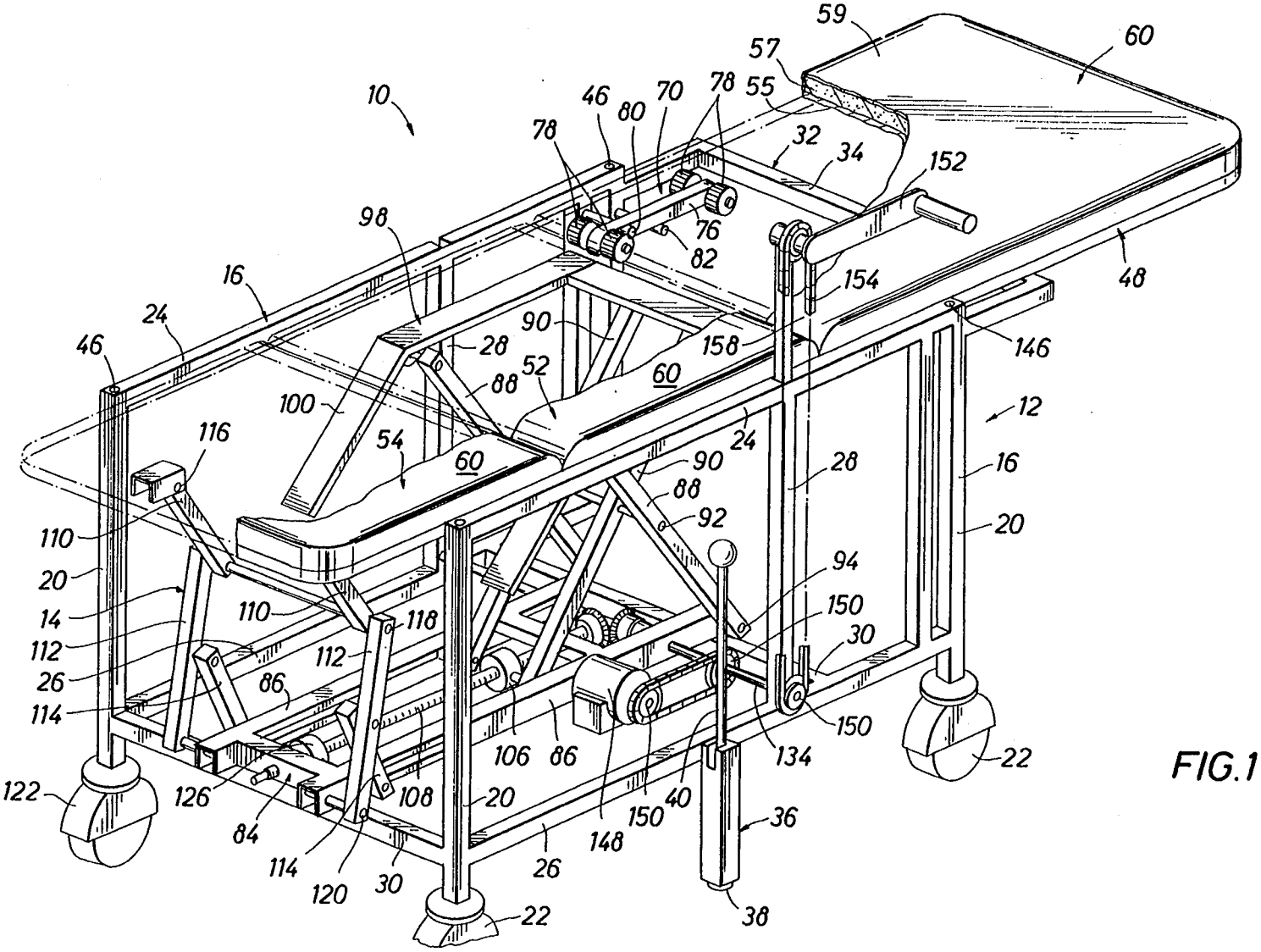
FIG. 1 is a perspective of the combined chair and gurney of the present invention with certain parts broken away and showing the device being utilized as a gurney to support a patient in a supine position.

Referring now to the drawings for a better understanding of the invention, and more particularly to the embodiment of the invention shown in FIGS. 1–9, the combined mobile chair and gurney is shown generally at 10 to provide a mobile transfer device for a patient. The combined chair and gurney 10 includes an outer support frame indicated at 12 and an inner movable frame generally indicated at 14. Inner movable frame 14 is supported on outer frame 12 for pivotal movement between several positions as explained below. Outer frame 12 includes a pair of opposed vertical side frames 16.

Each vertical side frame 16 has a pair of corner vertical frame members or posts 20 with a supporting wheel 22 pivotally connected to the lower end of each frame member 20 to permit the combined chair and gurney 10 to be easily moved or pushed along a supporting surface to define a mobile transport device for a patient. The term "wheel" as used in the specification and claims is intended to include casters, rollers, and other similar turning, rotating, or revolving members. Each side frame 16 has horizontally extending upper and lower frame members 24, 26 extending between corner frame members 20. Intermediate vertical frame members 28 extend between horizontal frame members 24, 26. Lower horizontal frame members 30 extend between the opposed side frames 16 and provide a lower support for inner movable frame 14.

To permit the combined chair and gurney or mobile transport device 10 to be easily pushed and guided manually, a rear bracket generally indicated at 32 is secured between side frames 16. A rear frame member 34 of bracket 32 may be gripped manually for pushing or guiding the mobile transport device 10 particularly when the patient is in a seated position. The rear lower frame member 30 between side frames 16 is positioned inwardly of adjacent corner frame members 20 so that an attendant will not engage rear frame member 30 when pushing and walking behind transport device 10.

Figure 6:
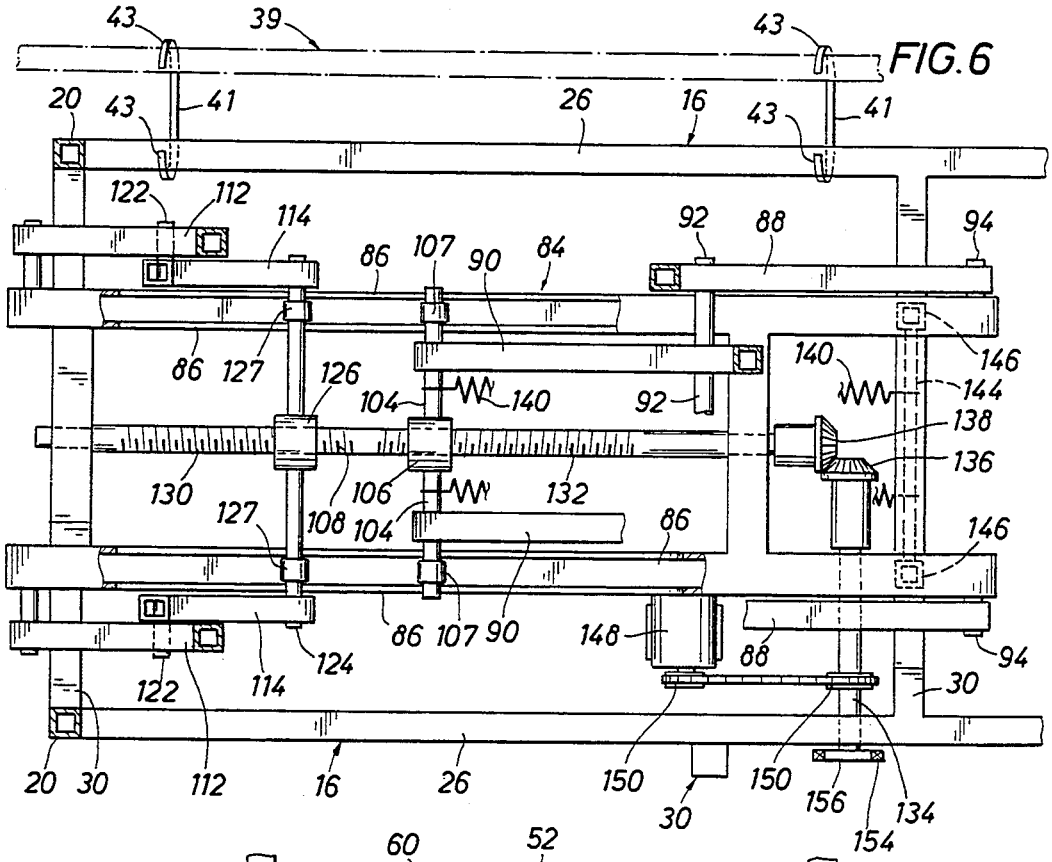
FIG. 6 is a section taken generally along line 6—6 of FIG. 5.

For retaining transport device 10 in a fixed position, a manually operated plunger generally indicated at 36 is secured to a lower horizontal frame member 26. Plunger 36 has a lower friction member 38 preferably formed of an elastomeric material adapted to engage the supporting surface. An actuating rod 40 is operatively connected through a suitable spring loaded toggle (not shown) to lower friction member 38 and upon movement to a horizontal position lifts friction member 38 out of engaged relation to permit movement of transport device 10. Upon manual movement of rod 40 to a vertical position, friction member 38 is released to engage the supporting surface or floor under spring loaded. At times a patient may be moved between the gurney and an adjacent operating table or bed frame shown partially at 39 in FIG. 6. To insure that the gurney and operating table or bed frame do not move away from each other during patient transfer, suitable elastic bungee cords 41 having end hooks 43 may be utilized as shown in FIG. 6. Bungee cords 41 may be carried by the ends of the gurney when not in use.

Figure 2:
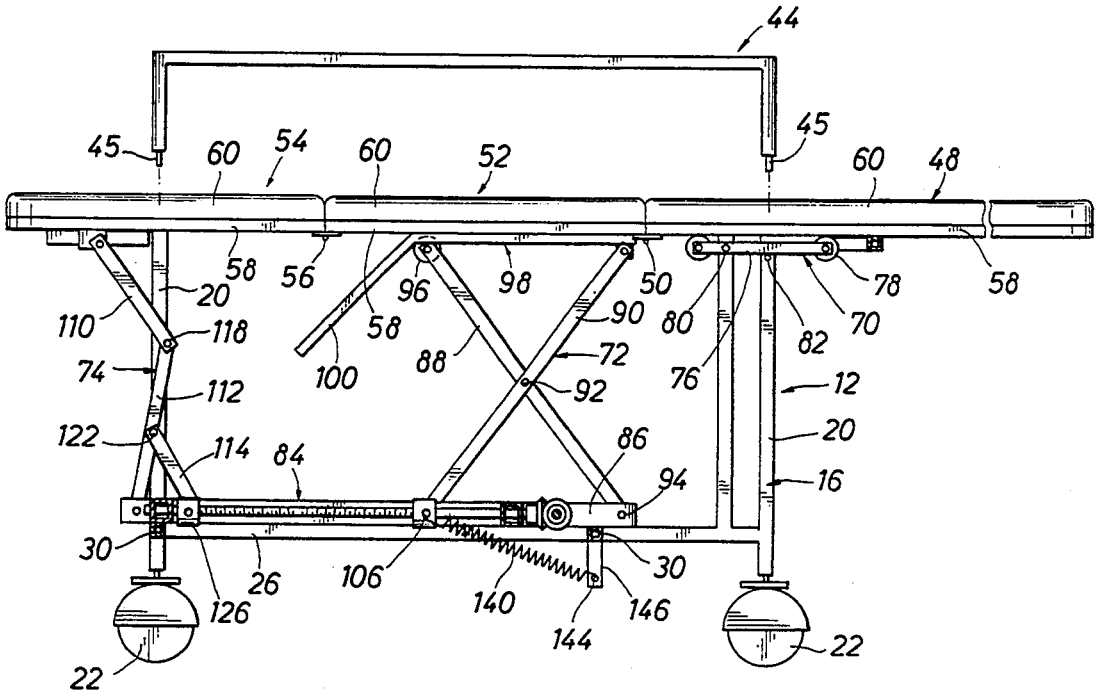
FIG. 2 is a side elevation with one side frame removed showing the combined chair and gurney of FIG. 1 where the patient may be supported in a supine position and showing a side extension adapted to be removably connected to a side frame for restricting lateral movement of the patient.
Figure 3:
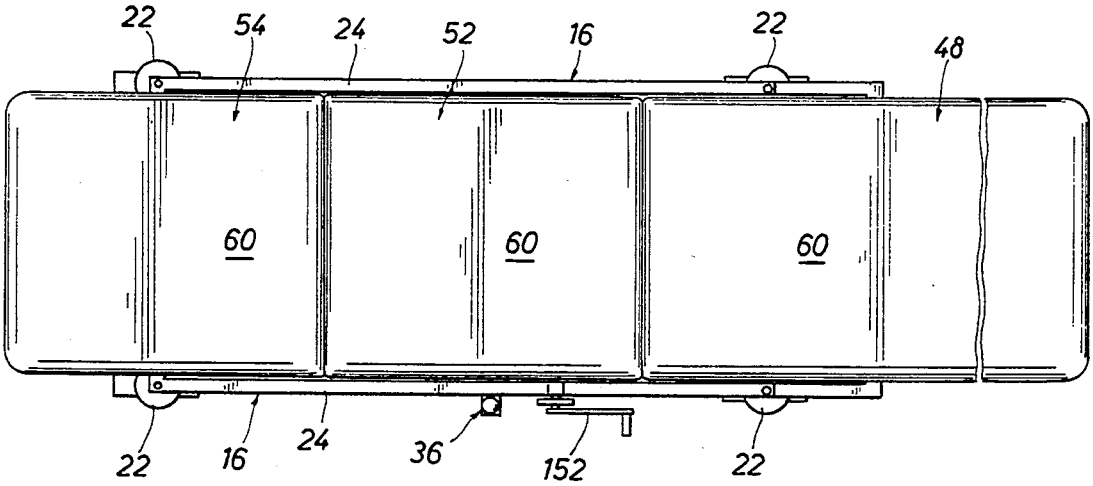
FIG. 3 is a top plan of the combined chair and gurney shown in FIGS. 1 and 2.

A removable upper side panel is shown generally at 44 in FIG. 2 and has lower prongs 45 which may be inserted within openings 46 in the upper ends of corner frame members 20 for positioning. Upper side panels 44 restrain lateral movement of the patient particularly when mobile transport device 10 is utilized as a gurney with the patient in a supine position. The upper side panel 44 adjacent an operating table is removed for transfer of the patient from the gurney to the operating table. A single side panel 44 or a pair of side panels 44 may be provided as desired.

Inner movable frame 14 includes three hinged segments or panels for supporting the patient. A rear back segment indicated at 48 is hinged at 50 to intermediate seat segment 52. A leg support segment 54 is hinged at 56 to intermediate seat segment 52. Each segment 48, 52, 54 has a base support frame 58 and a cushion or pad 60 removably secured to support frame 58 such as by snap attachments or Velcro strips. Pad 60, for example, may comprise three separate sections with one section for each hinged segment. Each section preferably includes a plywood backing member 55, a polyurethane foam layer 57, and an outer plastic cover 59 as shown in FIG. 1. Pads 60 may be filled with gel filled bags, rather than polyurethane foam, to further inhibit bed sore formation for patients who cannot move. The opposed sides or edges of adjacent pad sections may be suitably spaced, if desired, to eliminate any pinching of the patient between adjacent sections particularly where frame 14 is moved to the gurney position of FIG. 1.

Leg support segment 54 has a foot rest 62 secured to a pair of U-shaped brackets 64 (See FIGS. 4, 5) having ends telescopically received within tubular members 66 secured to frame 58 of leg support segment 54. An adjusting screw 68 may be adjusted to position brackets 64 within tubular members 66 at a predetermined position of foot rest 62. Alternatively U-Shaped brackets may be fixed with respect to frame 58 and foot rest 62 mounted on bracket 64 so as to be telescopially adjustable with respect thereto. Such adjustment allows foot rest 62 to be fitted to patients of different height.

Linkages generally indicated at 72 and 74 support respective segments 52 and 54. A pair of roller support frames generally indicated at 70 support segment 48. Each roller frame 70 includes a roller support bar 76 having rollers 78 mounted thereon for rotation. Bar 76 is pivotally mounted at 80 to adjacent side frame 16. A stop bar 82 on adjacent corner post 24 limits pivotal movement of roller frame 70 and segment 48 past the horizontal position shown in FIG. 1 at which position mobile transport device 10 is a gurney. If desired, a single roller support frame could be provided centrally of the width of back segment 48 and substituted for the pair of roller frames 70.

Inner movable frame 14 has a lower base for supporting linkages 72, 74 as shown generally at 84 (see FIGS. 1 and 2). Base 84 is supported on horizontal frame members 30 extending between side frames 16. Base 84 includes a pair of parallel base frame members 86 of a generally box-shape supported on frame members 30. Alternatively, box members 86 need not be of box-shape, but may be angled frame members having a flat lower surface to accept rollers 107 and 127 (see FIG. 6).

Figure 7:
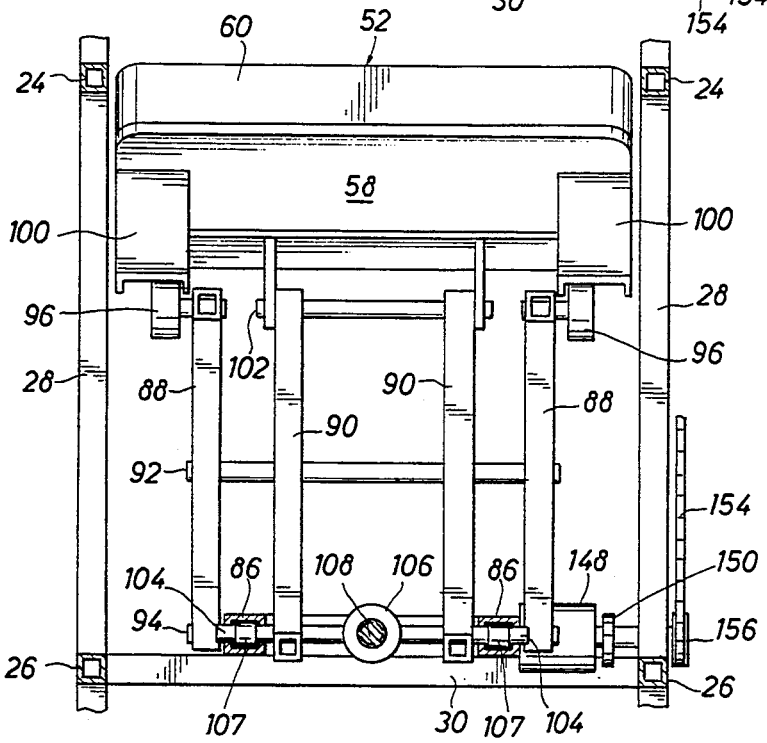
FIG. 7 is a section taken generally along line 7—7 of FIG. 5.

Linkage 72 includes two pairs of links 88 and 90 pivotally connected to each other about a shaft at 92. Links 88 have lower ends pivotally connected at 94 to base 84 and have rollers 96 at their upper ends. Tracks or guides 98 (FIGS. 2, 5, 6) are secured to the lower surface of seat segment 52 and have end portions 1 00 extending angularly from seat segment 52. Rollers 96 are mounted for riding along track end portions 100 from the lowermost position shown in FIG. 4 to the uppermost position shown in FIG. 2. Links 90 have upper ends pivoted at 102 to support frame 98 of seat support segment 52 and lower ends pivotally connected to a shaft 104 secured to opposite sides of a drive nut 106 in threaded engagement with an externally threaded power screw 108. Shaft 104 is received within opposed slots in box-type members 86. Rollers 107 received within frame members 86 are mounted on shaft 104 for movement along frame members 86 with shaft 104 as shown in FIGS. 6 and 7.

Linkage 74 has two pairs of links 110, 112, and 114. Links 110 have upper ends pivotally connected at 116 to leg support segment 54 and lower ends pivotally connected to links 112 at 118. Links 112 are pivotally connected adjacent their lower ends at 120 to base 84. Links 114 are pivotally connected adjacent their upper ends at 122 to links 112 and pivotally connected adjacent their lower end to a shaft 124 secured to opposite sides of a drive nut 126 in threaded engagement with externally threaded power screw 108. Shaft 124 is received within elongated slots in frame members 86. Rollers 127 received within frame members 86 are mounted on shaft 124 for movement along frame members 86. While drive nuts 106, 126 are shown as supported by horizontal shafts 104, 124, (see FIG. 6) it is to be understood that drive nuts 106, 126 may be supported by other means such as a vertically extending support, for example. Drive nuts 106, 126 may be, fabricated by threading a brass bar, for example.

Upon rotation of power screw 108, drive nuts 106 and 126 move in opposed directions for actuation of linkages 72 and 74. For that purpose, power screw 108 as shown in FIG. 6 has a right hand screw thread 130 for drive nut 126 and a left hand screw thread 132 for drive nut 106. A drive shaft 134 has a bevel gear 136 engaging bevel gear 138 on an end of power shaft 108 for rotation of shaft 108. Oil lite bearings may advantageously be provided between power screw and frame mounting members.

Figure 5:
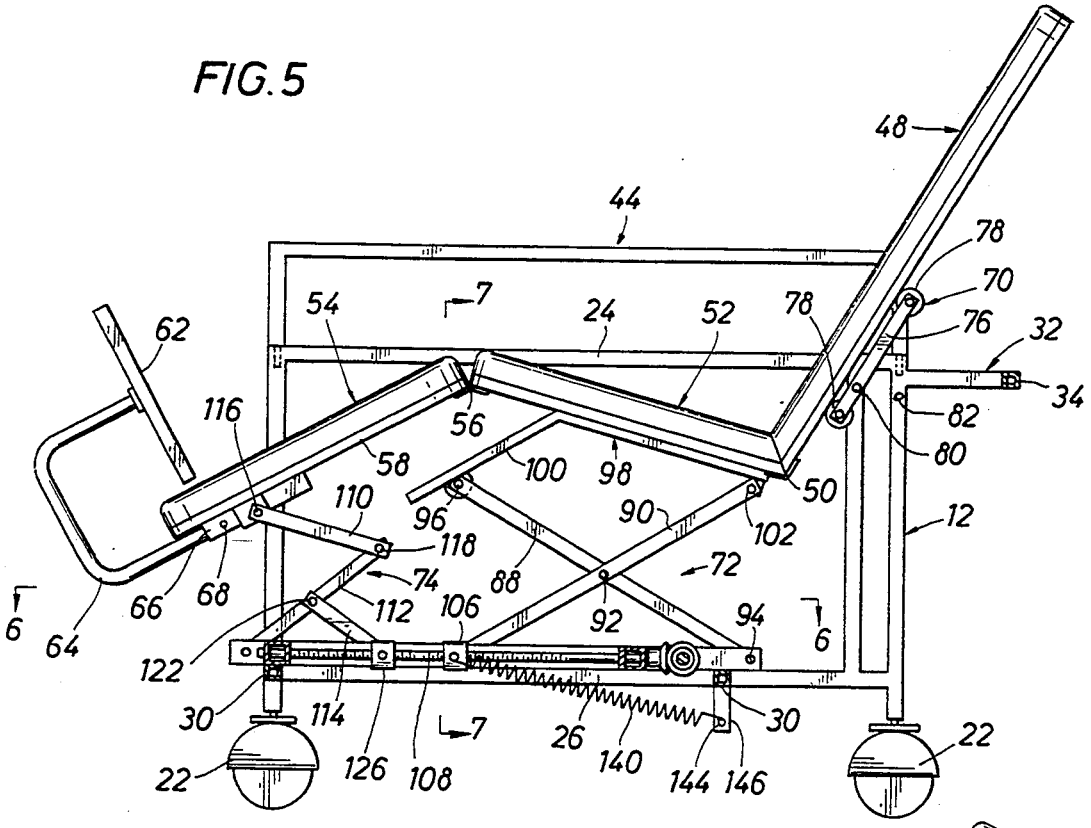
FIG. 5 is a side elevation similar to FIG. 4 but showing the chair in an intermediate position with the supporting hinged segments of the device in an inclined relation with the front end of the seat segment in a raised position relative to the rear end of the seat segment.
Figure 4:
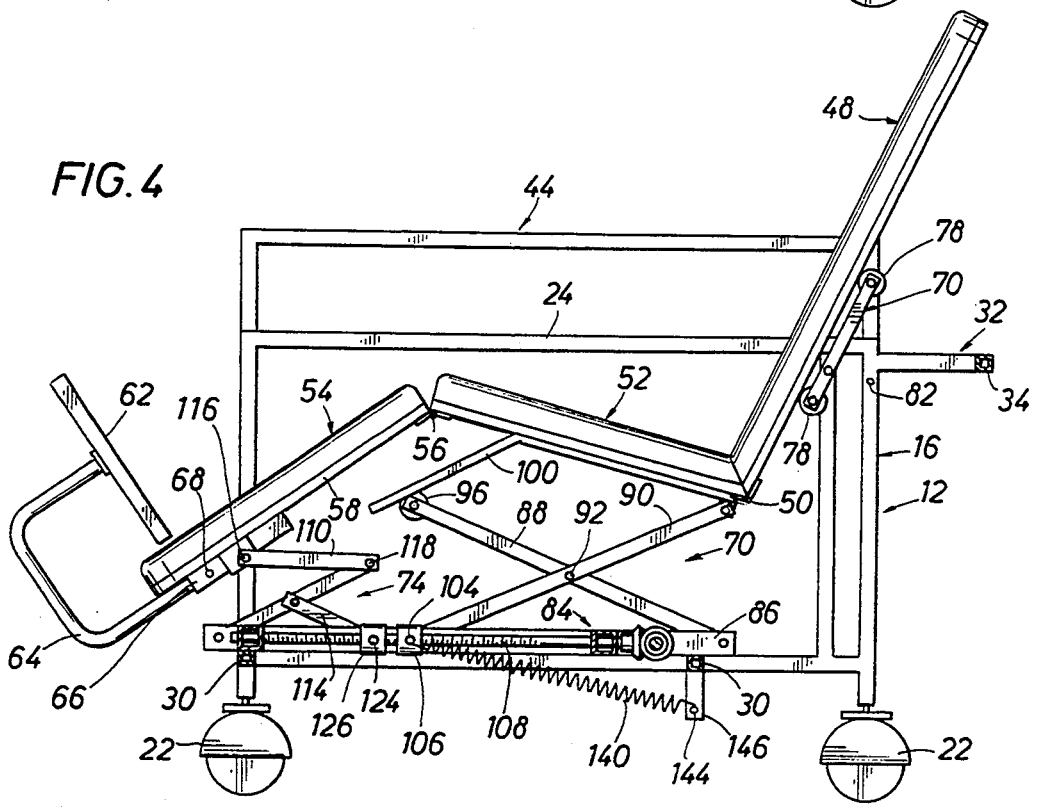
FIG. 4 is a side elevation similar to FIG. 2 but showing the patient transport device in a lowermost chair position for seating of a patient.

The weight of the patient on seat segment 52 acting on links 90 forces nut 106 to the left as viewed in FIGS. 4 and 5. To counterbalance the weight of the patient acting on nut 106, a pair of counterbalance springs 140 are connected to pins secured to nut 106 and forming the pivotal connection 104 for links 90 as shown particularly in FIG. 6. The other ends of springs 140 are anchored to shaft 144 secured between bars 146 extending downwardly from cross member 30. Counterbalance springs 140 may be of various sizes to obtain different levels of tension.

To position drive nuts 106 and 126 at a desired spaced relation on screw 108, drive nut 126 as shown in FIG. 8 has an outer gland 141 secured to shaft 124 (see FIG. 6). A set screw 131 secures gland 141 to nut 126. For assembly, drive nut 106 (see FIG. 6) is first threaded on screw 108, and then nut 126 is threaded on screw 108 to obtain the desired spaced relation. Set screw 131 is engaged at the desired spaced relation.

Referring to FIG. 9, drive nut 106 has an inner thrust bearing 139 engaging threads 132 on drive screw 108 and mounted within outer body 141 of drive nut 106. Thrust from either direction exerted by drive screw 108 against thrust bearing 139 is transmitted to nut 106. Alternatively, as mentioned above/drive nut 106 and drive nut 126 may each be a threaded brass bar.

As shown particularly in FIGS. 1 and 6, drive shaft 134 is rotated optionally from an electric motor 148 and sprockets 150. Motor 148 may be battery operated or powered from a source of a.c. voltage (not shown). Suitable controls (not shown) may be mounted on bracket 32 for control. Optionally, a hand operated crank 152 rotates an endless pulley belt or chain 154 connected to a pulley wheel 156 on an end of shaft 134. For mounting crank 152 for easy accessibility from a side of transport device 10 opposite the side from which a patient is adapted for transfer, a post 158 extends upwardly from the left side frame 16 and crank 152 is mounted on the extending end of support post 152 so that a patient may be transferred from the right side of mobile transport device 10. Suitable hand cranks may be mounted at any desired relation with associated connecting shafts for rotation of power screw 108.

The outer support frame 12 includes a pair, of side frames 16 and lower horizontal cross frame members 30 extending between the lower ends of side frames 16. The only cross member extending between the upper portions of side frames 16 is rear bracket 32 which includes a horizontal cross member 34 for gripping. Thus, outer support frame 12 provides a fixed frame which is open from the top to receive inner movable frame 14 which includes back support segment 48, seat support segment 52, and leg support segment 54 all mounted on a base 84. Segments 48, 52, 54 are not supported on or connected to side frames 16 and may move vertically and horizontally relative to side frames 16. Segments 48, 52 and 54 are supported on base 84 mounted on cross frame members 30. Thus, inner movable frame or subassembly 14 may be preassembled and then positioned within outer frame 12 with base 84 secured to cross members 30. Roller frames 70 and the hand operated drive from crank 152 may be positioned on outer frame 12 prior to insertion of inner frame 14. Shaft 134 and pulley 156 may be easily connected to belt or chain 154.

As shown in FIGS. 4 and 5, seat support segment 52 is inclined to provide comfortable seating for the patient. The amount of inclination may be varied depending on the desires of the patient. Since seat segment 52 is below the uppermost position of side frames 16 when in an inclined position, side frames 16 extend upwardly above seat segment 52 and provide a restraint against lateral movement of the patient. If desired, a suitable arm rest or protective mesh (not shown) may be provided on side frames 16.

The lowermost position of the combined chair and gurney 10 is shown in FIG. 4. The uppermost position is shown in FIG. 2. Drive nuts 106 and 126 are closely spaced to each other in FIG. 4, whereas in FIG. 2 the drive nuts 106 and 126 are spaced a maximum distance from each other. As a result of the left hand thread 132 for nut 106 and the right hand thread 130 for nut 126 as shown in FIG. 6, rotation of power screw 108 moves nuts 106 and 126 in opposite directions. Upon rotation of power screw 108 from the position shown in FIG. 4, nuts 106 and 126 move away from each other with rollers 96 moving along tracks 100 to tilt or incline seat segment 52 upwardly to an intermediate position as shown in FIG. 5. Upon further rotation of power screw 108, nuts 106 and 126 move to the position shown in FIG. 2 in which rollers 96 on the ends of links 88 are in an uppermost position with segments 48, 52, and 54 in a horizontal position to support a patient in a supine position. The inclination of seat segment 52 gradually changes from the inclination shown in FIG. 5 to the horizontal position shown in FIG. 2. Back segment 48 slides along rollers 78 from the pivotal action of seat segment 52 about pivot 50. Roller frames 70 pivot about shaft 80 and engage stop bars 82 in the horizontal position of back segment 48 shown in FIG. 2.

As illustrated in FIG. 4, when seat segment 52 is fully lowered, the rear edge of seat segment 52 at hinge 50 is substantially lower than the front edge of segment 52 at hinge 56 thereby giving the patient a seat which is tilted rearwardly as in a lounger or swivel chair. As seat segment 52 is lowered from the gurney position shown in FIG. 2, back segment 48 tilts downwardly along hinge 50 and roller frames 70 follow the inclination of back segment 48 pivoting about hinge 80 with rollers 78 engaging the lower support frame 58 of back segment 48. As seat segment 52 is lowered from the position shown in FIG. 2, side frames 16, particularly upper frame members 24 thereof, provide a lateral restraint to keep the patient from rolling or falling off the mobile transport device 10. Upper frame members 24 may also be useful when in a chair position to have trays or other implements attached thereto. Pads 60 as shown particularly in FIG. 1 which are removably positioned on segments 48, 52, and 54 are formed of an outer plastic material 59 with a suitable inner foam material 57 thereby to provide a removable, comfortable pad designed for easy cleaning and patient comfort.

Figure 10:
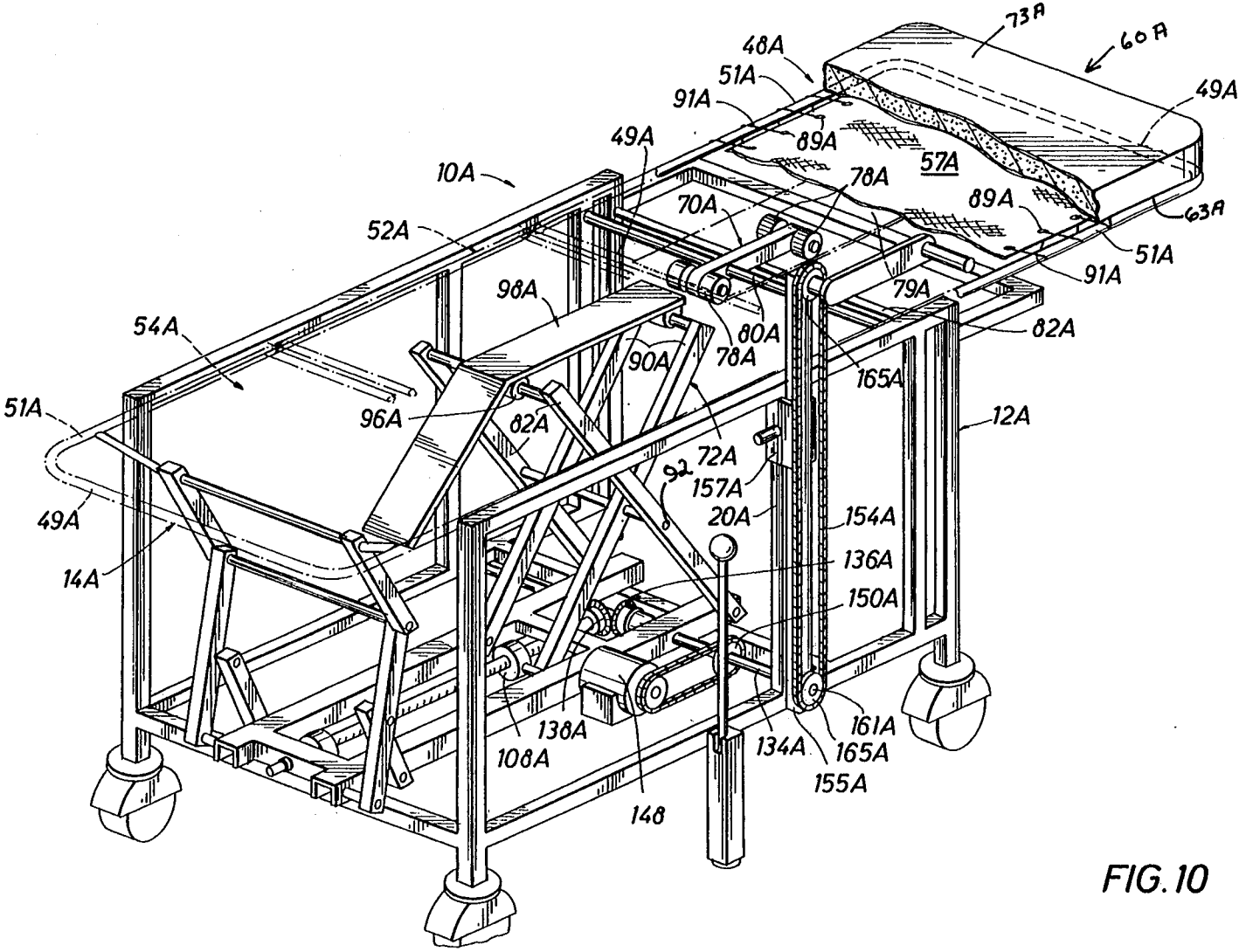
FIG. 10 is a perspective of a modification of the combined chair and gurney which may be actuated from either side.
Figure 11:
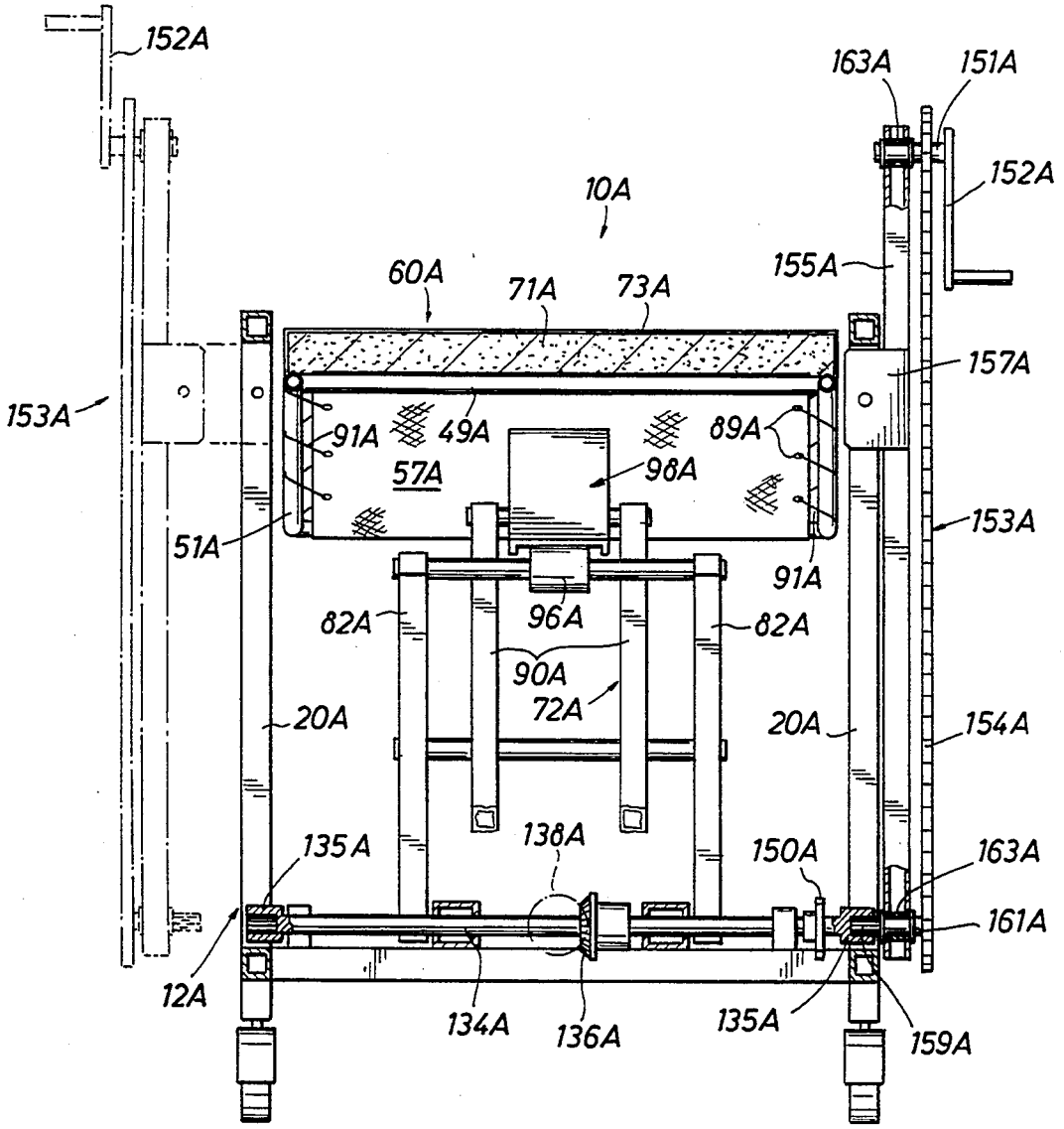
FIG. 11 is an elevation of the modified chair and gurney shown in FIG. 10.

Referring to FIGS. 10 and 11 a separate embodiment of this invention is shown generally similar to the embodiment of FIGS. 1–9 but illustrating certain modifications. A single roller support frame 70A mounted on shaft 80A is provided having rollers 78A mounted thereon for movement along a supporting plate 79A secured between end tubular frame members 49A of back segment 48A of inner movable frame 14. Side tubular members 51A form the sides of back segment 48A. Shaft 82A provides a stop for roller frame 70A.

Linkage 72A includes a pair of links 90A and a pair of links 82A pivotally connected to each other about a shaft 92. Links 82A have a roller 96A at their upper ends for contacting and riding along a guide 98A positioned centrally of the width of inner movable frame 14A. Guide 98A is adapted to contact the lower surface of seat segment 52A, as illustrated in the embodiment of FIGS. 2, 4, and 5.

For actuation of linkage 72A and rotation of drive screw 108A, a drive shaft 134A extends across the entire width of fixed outer frame 12A and has a splined closed end socket 135A on each end thereof as shown in FIG. 11. A bevel gear 136A on shaft 134A is in engagement with bevel gear 138A on drive screw 108A. A sprocket 150A on drive shaft 134A is adapted for rotation selectively by a motor 148A or by manual rotation of a handle 152A on a detachable manual drive unit generally indicated at 153A. Manual drive unit 153A is mounted for detachable connection on adjacent vertical frame member 20A of fixed outer frame 12A. Drive unit 153A includes a vertical housing 155A having an attachment bracket 157A for releasable attachment to vertical frame member 20A by suitable nut and bolt combinations. Handle 152A has a shaft 151A mounted on the upper end of housing 155A for rotation. The hand hold portion of handle 152A may be hinged so as to be inline with handle 152A for storage or perpendicular thereto for operation. An externally splined gear 159A is mounted on the end of shaft 161A on the lower end of housing 155A.

Alternatively, the end of the shaft 161A may be provided with a female connection having radially opposed slots therein. The end of shaft 134A may have a Tee-shaped end to fit within the slots of the female connection. Such arrangement provides quick connection between drive unit 153A as it is moved to from one side of the transport device 10A to the other for connection to drive shaft 134A.

Suitable bearings 163A are provided on housing 155A for shaft 161A and for shaft 151A of handle 152A. Sprockets 165A are secured to shafts 151A and 161A. Sprocket chain 154A is mounted over sprockets 165A. Thus, upon manual rotation of handle 152A, shaft 134A is rotated and meshing bevel gears 136A and 138A rotate drive screw 108A for selective movement of movable inner frame 14A.

It may be desirable to mount drive unit 153A on the opposite side of mobile chair and gurney 10A as indicated in broken lines in FIG. 11 in the event gurney 10A is positioned on an opposed side of the patient's bed since handle 152A is normally positioned on the side of gurney 10A opposite the patient's bed. For that purpose, bracket 157A is disconnected from vertical frame member 20A and drive unit 153A is pulled outwardly to remove spline gear 159A (or alternatively a T connection from a female member with radially opposed slots) from socket 135A. Drive unit 153A may then be attached to vertical frame member 20A on the opposite side of gurney 10A in a similar manner.

Inner movable frame 14A comprising segments 48A, 52A, and 54A is formed of tubular cylindrical frame members 51A. Such frame members, like many of the other frame members are fabricated from stainless steel. A backing layer 57A of material formed of nylon and Dacron has grommets 89A through which suitable string ties 91A are threaded and wrapped tightly and secured about frame members 51A for maintaining lower base or backing 57A in a taut relation. A separate backing 57A is provided for each segment 48A, 52A, and 54A.

As shown particularly in FIG. 12, a separate connecting strip 93A is secured between adjacent backings 57A and loosely extends over the adjacent tubular frame members 49A. Strip 63A is preferably formed of nylon and, if desired, a cushioned layer may be provided for strip 93A over frame members 49A.

Adjacent members 48, 52, 54 are hinged by hinges 50, 56 as shown in FIGS. 4 and 5. Such hinges preferably take the form of short tubular members fixed at the ends of backings 48, 52 and 52, 54. A shaft extends through such tubular sections to form the hinge. For the case of hinge 50, such shaft may also extend through holes in links 90 of linkage 72 to provide a pivot for such linkage.

Referring to FIG. 13, a pad 60A for positioning over segments 48A, 52A, and 54A is illustrated having three hinged or articulated sections 61A. Each end of the lower surface of pad 60A has a substantially rigid plastic clip or bracket 63A for fitting about an adjacent tubular end frame member 49A of end segments 48A and 54A as shown in FIG. 10. Velcro straps 67A secured to the lower surface of pad 60A are operatively arranged to engage about frame members 51A of the movable inner frame 14A for securement of pad 60A. Pad 60A includes an inner layer of suitable polyurethane material 71A (or suitable gel filled bags) and an outer plastic cover 73A, such as polyvinylchloride which may be easily cleaned.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A mobile transport device for a patient convertible between a chair with the patient in a seated inclined relation and a gurney with the patient in a prostrate position; said device comprising:

an outer support frame including a pair of generally parallel side flames supported on wheels for movement;

a plurality of cross members extending between and connecting the lower ends of said side frames to each other;

an inner support frame mounted on said cross members between said side frames of said outer support frame and including three generally planar segments hinged to each other to define an intermediate seat segment and opposed end segments defining a back segment and a leg segment for supporting a patient thereon;

said inner support frame including actuating means for raising said hinged segments between a lowermost position defining a chair with said segments in an inclined position relative to each other and to a horizontal plane, and an uppermost position defining a gurney with said segments aligned horizontally to support a patient in supine relation; said actuating means including a first linkage operatively connected to said intermediate seat segment, a separate second linkage operatively connected to said leg segment;

drive means connected to said first and second linkages for actuating said linkages simultaneously for movement of the hinged sections between the lowermost seated position of the patient and the uppermost supine position of the patient; and a plurality of rollers supporting said back segment for sliding movement relative to said side frames upon movement of said segment between lowermost and uppermost positions.

2. A mobile transport device as set forth in claim 1 wherein a roller frame is mounted on said side frames for pivotal movement during movement of said segments between lowermost and uppermost positions, and said plurality of rollers are carried on said roller frame for contacting said back segment.

3. A mobile transport device for a patient convertible between a chair with the patient in a seated inclined relation and a gurney with the patient in a supine position; said device comprising:

an outer support frame including a pair of generally parallel side frames supported on wheels for movement;

a plurality of cross members extending between and connecting the lower ends of said side frames to each other;

an inner support frame mounted on said lower horizontal cross members between said side frames of said outer support frame and including three generally planar segments hinged to each other to define an intermediate seat segment and opposed end segments defining a back segment and a leg segment for supporting a patient thereon;

linkage means for said inner support frame pivotally connected to said hinged segments for movement of said hinged segments between lowermost and uppermost positions;

a generally horizontally extending externally threaded power screw on said inner support frame;

internally threaded drive nut means in threaded engagement with said externally threaded screw and operatively connected to said linkage means for actuation of said linkage means and movement of said hinged segments;

said linkage means including a first linkage for said intermediate seat segment and a second linkage for said leg segment, said drive nut means including a separate nut for each linkage;

means for selectively rotating said power screw for moving said nuts along said power screw for raising and lowering said hinged segments;

said first linkage urging the associated nut in one direction along said power screw when a patient is seated on said seat segment, and counterbalance means operatively connected to said associated nut to move said associated nut in an opposite direction along said screw.

4. A mobile transport device as set forth in claim 3 wherein said counterbalance means comprises a spring urging said associated nut continuously in said opposite direction.

5. A mobile transport device for a patient convertible between a chair with the patient in a seated inclined relation and a gurney with the patient in a supine position; said device comprising:

an outer support frame including a pair of generally parallel side frames supported on wheels for movement;

a plurality of cross members extending between and connecting the lower ends of said side frames to each other;

an inner support frame mounted on said lower horizontal cross members between said side frames of said outer support frame and including three generally planar segments hinged to each other to define an intermediate seat segment and opposed end segments defining a back segment and a leg segment for supporting a patient thereon;

linkage means for said inner support frame pivotally connected to said hinged segments for movement of said hinged segments between lowermost and uppermost positions;

a generally horizontally extending externally threaded power screw on said inner support frame;

internally threaded drive nut means in threaded engagement with said externally threaded screw and operatively connected to said linkage means for actuation of said linkage means and movement of said hinged segments;

means for selectively rotating said power screw for moving said nut means along said power screw for raising and lowering said hinged segments;

said linkage means including a first linkage for said intermediate seat segment and a separate second linkage for said leg segment, said drive nut means including a separate nut for each linkage operatively connected to the associated linkage for raising and lowering the associated segment; and rollers supporting said back segment for simultaneous movement with said seat segment.

6. A mobile transport device as set forth in claim 5 wherein roller frames are pivotally mounted on said side frame and support said rollers for rotation.

7. A mobile transport device as set forth in claim 5 wherein a manually operated plunger is mounted on a side frame and has a lower friction member thereon adapted to engage a supporting surface for the transport device to restrain the transport device against movement.

8. A mobile transport device as set forth in claim 5 wherein a motor is operatively connected to said power screw for rotating said power screw to raise and lower said hinged segments.

9. A mobile transport device as set forth in claim 5 wherein a foot rest is mounted on said leg segments.

10. A mobile transport device for a patient convertible between a chair with the patient in a seated inclined relation and a gurney with the patient in a supine position; said device comprising:

an outer support frame including a pair of generally parallel side frames supported on wheels for movement;

a plurality of cross members extending between and connecting the lower ends of said side frames to each other;

an inner support frame mounted on said lower horizontal cross members between said side frames of said outer support frame and including three generally planar segments hinged to each other to define an intermediate seat segment and opposed end segments defining a back segment and a leg segment for supporting a patient thereon;

linkage means for said inner support frame pivotally connected to said hinged segments for movement of said hinged segments between lowermost and uppermost positions;

a generally horizontally extending externally threaded power screw on said inner support frame;

internally threaded drive nut means in threaded engagement with said externally threaded screw and operatively connected to said linkage means for actuation of said linkage means and movement of said hinged segments;

means for selectively rotating said power screw for moving said nut means along said power screw for raising and lowering said hinged segments;

said drive nut means having an inner thrust bearing engaging threads on said externally threaded screw so that thrust from either direction exerted by said screw against said thrust bearing is transmitted to said drive nut means;

said linkage means including a first linkage for said intermediate seat segment and a separate second linkage for said leg segment, said drive nut means including a separate nut for each linkage operatively connected to the associated linkage for raising and lowering the associated segment.

11. A mobile transport device for a patient as set forth in claim 10 wherein said nuts are mounted on said power screw for movement in opposite directions.

* * * * *